US011232732B2

(12) United States Patent
Huang et al.

(10) Patent No.: US 11,232,732 B2
(45) Date of Patent: Jan. 25, 2022

(54) GATE DRIVING MODULE, GATE DRIVING CONTROL METHOD AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Weiyun Huang, Beijing (CN); Youngyik Ko, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 374 days.

(21) Appl. No.: 16/475,301

(22) PCT Filed: Dec. 7, 2018

(86) PCT No.: PCT/CN2018/119772

§ 371 (c)(1),
(2) Date: Jul. 1, 2019

(87) PCT Pub. No.: WO2019/196447

PCT Pub. Date: Oct. 17, 2019

(65) Prior Publication Data

US 2021/0343209 A1 Nov. 4, 2021

(30) Foreign Application Priority Data

Apr. 13, 2018 (CN) ..... 201810329788.9

(51) Int. Cl.
*G09G 3/20* (2006.01)
*G09G 3/00* (2006.01)

(52) U.S. Cl.
CPC ..... *G09G 3/20* (2013.01); *G09G 3/006* (2013.01); *G09G 2310/0286* (2013.01); *G09G 2310/08* (2013.01); *G09G 2380/02* (2013.01)

(58) Field of Classification Search
CPC .... G09G 3/3266; G09G 2380/02; G09G 3/03; G06F 1/1652
See application file for complete search history.

(56) References Cited

U.S. PATENT DOCUMENTS

2007/0194319 A1 8/2007 An et al.
2009/0122034 A1 3/2009 Shin et al.
(Continued)

FOREIGN PATENT DOCUMENTS

CN 101025906 A 8/2007
CN 101436371 A 5/2009
(Continued)

OTHER PUBLICATIONS

International Search Report and Written Opinion for Application No. PCT/CN2018/119772, dated Feb. 27, 2019, 12 Pages.
(Continued)

*Primary Examiner* — Gerald Johnson
(74) *Attorney, Agent, or Firm* — Brooks Kushman P.C.

(57) ABSTRACT

The present disclosure provides a gate driving module, including a gate driving circuit and a control circuit. The gate driving circuit includes a first shift register sub-circuitry and a second shift register sub-circuitry connected to each other in a cascaded manner. A first shift register unit is connected to a corresponding gate line at a first display sub-region. A second shift register unit is connected to a clock signal line and a corresponding gate line at a second display sub-region, and configured to generate a gate driving signal in accordance with a voltage signal on the clock signal line and output the gate driving signal to the gate line. The
(Continued)

control circuit is configured to, when a display panel is in a non-planar state and the second shift register unit is performing a gate driving scanning operation, apply a first voltage signal to the clock signal line, so as to enable the second shift register unit to output a signal for turning off a transistor corresponding to the gate line.

20 Claims, 5 Drawing Sheets

(56) References Cited

U.S. PATENT DOCUMENTS

| | | | | |
|---|---|---|---|---|
| 2009/0147224 | A1* | 6/2009 | Kurozuka | H04N 9/3129 353/98 |
| 2015/0035777 | A1 | 2/2015 | Hirakata et al. | |
| 2015/0348508 | A1 | 12/2015 | Her | |
| 2016/0155422 | A1 | 6/2016 | Sun | |
| 2016/0372078 | A1 | 12/2016 | Song et al. | |
| 2017/0033126 | A1 | 2/2017 | Miyaguchi | |
| 2017/0148419 | A1 | 5/2017 | Zhang et al. | |
| 2018/0075808 | A1 | 3/2018 | Yamashita et al. | |
| 2018/0088654 | A1* | 3/2018 | Liu | G06F 1/3265 |
| 2018/0102096 | A1 | 4/2018 | Lee et al. | |
| 2018/0166018 | A1* | 6/2018 | Yang | H01L 27/32 |

FOREIGN PATENT DOCUMENTS

| | | | |
|---|---|---|---|
| CN | 104537970 | A | 4/2015 |
| CN | 104658466 | A | 5/2015 |
| CN | 104851369 | A | 8/2015 |
| CN | 106328081 | A | 1/2017 |
| CN | 106504714 | A | 3/2017 |

OTHER PUBLICATIONS

First Office Action for Chinese Application No. 201810329788.9, dated Mar. 16, 2020, 11 Pages.

Extended European Search Report for European Application No. 18889953.8, dated Dec. 2, 2021, 16 Pages.

* cited by examiner

GATE DRIVING MODULE, GATE DRIVING CONTROL METHOD AND DISPLAY DEVICE

CROSS-REFERENCE TO RELATED APPLICATIONS

This application is the U.S. national phase of PCT Application No. PCT/CN2018/119772 filed on Dec. 7, 2018, which claims priority to Chinese Patent Application No. 201810329788.9 filed on Apr. 13, 2018, which are incorporated herein by reference in their entireties.

TECHNICAL FIELD

The present disclosure relates to the field of display driving technology, in particular to a gate driving module, a gate driving control method and a display device.

BACKGROUND

Flexible display panel is foldable and may be applied to a foldable terminal, e.g., a foldable mobile phone or a foldable flat-panel computer. Usually, when the foldable terminal is unfolded, it is necessary to display an image in a double-sided manner, and when the foldable terminal is folded, it is merely necessary to display an image in a single-sided manner. In order to reduce the power consumption, it is necessary to turn off shift register units at a region where no image is to be displayed. A conventional scheme is to provide at least two gate driving circuits for at least two display sub-regions of a display panel when the display panel is folded. In this way, each display sub-region is controlled by one gate driving circuit. However, at this time, a driving Integrated Circuit (IC) needs to support more clock signals and start signals. In addition, the at least two gate driving circuits are not connected to each other in cascaded manner, so during a gate driving scanning operation, clock signal mismatch may easily occur, and there may exist differences between gate loadings for the at least two gate driving circuits. As a result, such a phenomenon as split-screen may occur at the at least two display sub-regions when an image is displayed in a full-screen mode.

SUMMARY

In one aspect, the present disclosure provides in some embodiments a gate driving module for use in a display panel provided with a display region. When the display panel is in a non-planar state, the display region includes a plurality of display sub-regions. The gate driving module includes a gate driving circuit. The gate driving circuit includes a plurality of shift register sub-circuitries connected to each other in a cascaded manner. A first shift register sub-circuitry of the plurality of shift register sub-circuitries includes at least one level of first shift register unit, and a second shift register sub-circuitry of the plurality of shift register sub-circuitries includes at least one level of second shift register unit. The gate driving module further includes a control circuit. Each first shift register unit of the at least one level of first shift register unit is connected to a gate line at a first display sub-region of the plurality of display sub-regions. Each second shift register unit of the at least one level of second shift register unit is connected to a clock signal line and a gate line arranged at a second display sub-region of the plurality of display sub-regions, and configured to generate a gate driving signal in accordance with a voltage signal on the clock signal line and output the gate driving signal to the gate line. The control circuit is configured to, when the display panel is in the non-planar state and one second shift register unit of the at least one level of second shift register unit is performing a gate driving scanning operation, apply a first voltage signal to the clock signal line, so as to enable the second shift register unit to control the gate line to output a signal for turning off a transistor corresponding to the gate line.

In a possible embodiment of the present disclosure, when the display panel is in the non-planar state, the display panel is folded, and the display region is divided by one or more folding axes into a plurality of display sub-regions; or when the display panel is the non-planar state, the display panel is curled.

In a possible embodiment of the present disclosure, there are one folding axis, one first shift register sub-circuitry and one second shift register sub-circuitry. A gate driving signal output end of a last-level first shift register unit of the first shift register sub-circuitry is connected to an input end of a first-level second shift register unit of the second shift register sub-circuitry, and a gate driving signal output end of the first-level second shift register unit of the second shift register sub-circuitry is connected to a resetting end of the last-level first shift register unit of the first shift register sub-circuitry.

In a possible embodiment of the present disclosure, there are two folding axes, two first register sub-circuitries, two first display sub-regions corresponding to the first register unit sub-circuitries respectively, one second shift register sub-circuitry and one second display sub-region. A gate driving signal output end of a last-level first shift register unit of a first one of the first shift register sub-circuitries is connected to an input end of a first-level second shift register unit of the second shift register sub-circuitry, a gate driving signal output end of the first-level second shift register unit of the second shift register sub-circuitry is connected to a resetting end of the last-level first shift register unit of the first one of the first shift register sub-circuitries, a gate driving signal output end of the last-level second shift register unit of the second shift register sub-circuitry is connected to an input end of a first-level first shift register unit of a second one of the first shift register sub-circuitries, and a gate driving signal output end of the first-level first shift register unit of the second one of the first shift register sub-circuitries is connected to a resetting end of the last-level second shift register unit of the second shift register sub-circuitry.

In a possible embodiment of the present disclosure, the first shift register unit is further connected to the clock signal line, and configured to generate a gate driving signal in accordance with the voltage signal on the clock signal line and output the gate driving signal to the gate line connected to the first shift register unit. The control circuit is further configured to, when the display panel is in the non-planar state and the first shift register unit is performing a gate driving scanning operation, apply the clock signal to the clock signal line, so as to enable the first shift register unit to control the gate line to output a signal for turning on the transistor corresponding to the gate line.

In a possible embodiment of the present disclosure, the control circuit is further configured to, when the display panel is in the non-planar state, apply the clock signal to the clock signal line, so as to enable the first shift register unit to control the gate line to output a signal for turning on the transistor corresponding to the gate line when the first shift register unit is performing a gate driving scanning operation, and enable the second shift register unit to control the gate line to output a signal for turning on the transistor corresponding to the gate line when the second shift register unit is performing a gate driving scanning operation.

In a possible embodiment of the present disclosure, when the display panel is in a planar state, the display panel is changed from a folded state to an unfolded state; or when the display panel is in the planar state, the display panel is changed from a curled state to the unfolded state.

In a possible embodiment of the present disclosure, the gate driving module further includes a detection circuit configured to detect whether the display panel is in the non-planar state or the planar state, generate a corresponding state indication signal, and transmit the state indication signal to the control circuit.

In a possible embodiment of the present disclosure, the control circuit is further configured to, within a black image display time period immediately before a non-planar time period, apply a predetermined data voltage to a data line connected to a subpixel at the second display sub-region, thereby to enable the subpixel to display a black image. The non-planar time period is a time period within which a first voltage signal is applied by the control circuit to the clock signal line.

In a possible embodiment of the present disclosure, the clock signal line includes a first clock signal line and a second clock signal line. Odd-numbered-level first shift register units of the first shift register sub-circuitry are connected to the first clock signal input end, and even-numbered-level first shift register units of the first shift register sub-circuitry are connected to the second clock signal input end. The first shift register sub-circuitry includes even-numbered levels of first shift register units, odd-numbered-level second shift register units of the second shift register sub-circuitry are connected to the first clock signal input end, and even-numbered-level second shift register units of the second shift register sub-circuitry are connected to the second clock signal input end.

In a possible embodiment of the present disclosure, the clock signal line includes a first clock signal line and a second clock signal line. Odd-numbered-level first shift register units of the first shift register sub-circuitry are connected to the first clock signal input end, and even-numbered-level first shift register units of the first shift register sub-circuitry are connected to the second clock signal input end. The first shift register sub-circuitry includes odd-numbered levels of first shift register units, odd-numbered-level second shift register units of the second shift register sub-circuitry are connected to the second clock signal input end, and even-numbered-level second shift register units of the second shift register sub-circuitry are connected to the first clock signal input end.

In another aspect, the present disclosure provides in some embodiments a gate driving control method for use in the above-mentioned gate driving module, including, when the display panel is in a non-planar state and the second shift register unit is performing a gate driving scanning operation, applying, by the control circuit, a first voltage signal to the clock signal line, so as to enable the second shift register unit to control the gate line to output a signal for turning off the transistor corresponding to the gate line.

In a possible embodiment of the present disclosure, the first shift register unit is further connected to the clock signal line. The gate driving control method further includes, when the display panel is in the non-planar state and the first shift register unit is performing the gate driving scanning operation, applying, by the control circuit, a clock signal to the clock signal line, so as to enable the first shift register unit to control the gate line to output a signal for turning on the transistor corresponding to the gate line.

In a possible embodiment of the present disclosure, the gate driving control method further includes, when the display panel is in a planar state, applying, by the control circuit, a clock signal to the clock signal line, so as to enable the first shift register unit to control the gate line to output the signal for turning on the transistor corresponding to the gate line when the first register unit is performing the gate driving scanning operation, and enable the second shift register unit to control the gate line to output the signal for turning on the transistor corresponding to the gate line when the second shift register unit is performing the gate driving scanning operation.

In a possible embodiment of the present disclosure, the gate driving module further includes a detection circuit, and the gate driving control method further includes detecting, by the detection circuit, whether the display panel is in the non-planar state or the planar state, generating a corresponding state indication signal, and transmitting the state indication signal to the control circuit.

In a possible embodiment of the present disclosure, the gate driving control method further includes, within a black image display time period immediately before a non-planar time period, applying, by the control circuit, a predetermined data voltage to a data line connected to a subpixel at a second display sub-region, so as to enable the subpixel to display a black image. The non-planar time period is a time period within which a first voltage signal is applied by the control circuit to the clock signal line.

In yet another aspect, the present disclosure provides in some embodiments a display device including the above-mentioned gate driving module.

In a possible embodiment of the present disclosure, the display device further includes a driving integrated circuit and a plurality of gate lines extending in a first direction. Each folding axis extends in the first direction, and a control circuit of the gate driving module is arranged in the driving integrated circuit.

In a possible embodiment of the present disclosure, a gate driving circuit of the gate driving module is arranged at a peripheral region of a display panel to which an extension direction of the plurality of gate lines points.

In a possible embodiment of the present disclosure, the plurality of gate lines is arranged in a longitudinal direction, the gate driving circuit of the gate driving module is arranged at an upper side or a lower side of the display panel, and the longitudinal direction is substantially the same as the first direction.

In a possible embodiment of the present disclosure, the plurality of gate lines is arranged in a longitudinal direction. The gate driving module includes two gate driving circuits. A first gate driving circuit of the two gate driving circuits is arranged at an upper side of the display panel in such a manner that each shift register unit is connected to an upper end of the corresponding gate line, and a second gate driving circuit of the two gate driving circuits is arranged at a lower side of the display panel in such a manner that each shift register unit is connected to a lower end of the corresponding gate line. The longitudinal direction is substantially the same as the first direction.

In a possible embodiment of the present disclosure, the first gate diving circuit and the second gate driving circuit are each a Gate On Array (GOA) circuit arranged on an array substrate.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION

Figure 1:
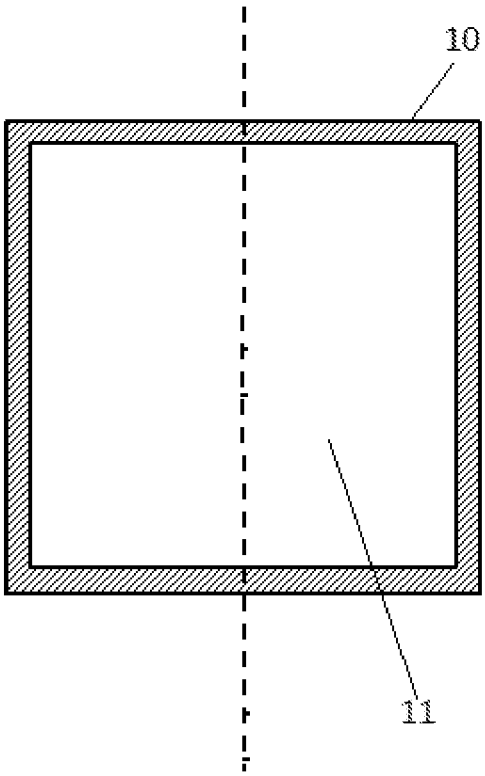
FIG. 1 is a schematic view showing a display panel including a gate driving module in an unfolded state (i.e., a planar state) according to one embodiment of the present disclosure.

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

All transistors adopted in the embodiments of the present disclosure may be thin film transistors (TFTs), field effect transistors (FETs) or any other elements having an identical characteristic. In order to differentiate two electrodes other than a gate electrode from each other, one of the two electrodes is called as first electrode and the other is called as second electrode. In actual use, the first electrode may be a drain electrode while the second electrode may be a source electrode, or the first electrode may be a source electrode while the second electrode may be a drain electrode.

The present disclosure provides in some embodiments a gate driving module for use in a display panel provided with a display region. When the display panel is in a folded state, the display region is divided by one or more folding axes into a plurality of display sub-regions. The gate driving module includes a gate driving circuit. The gate driving circuit includes a plurality of shift register sub-circuitries connected to each other in a cascaded manner. A first shift register sub-circuitry of the plurality of shift register sub-circuitries includes at least one level of first shift register unit, and a second shift register sub-circuitry of the plurality of shift register sub-circuitries includes at least one level of second shift register unit. The gate driving module further includes a control circuit. Each first shift register unit of the at least one level of first shift register unit is connected to a gate line at a first display sub-region of the plurality of display sub-regions. Each second shift register unit of the at least one level of second shift register unit is connected to a clock signal line and a gate line arranged at a second display sub-region of the plurality of display sub-regions, and configured to generate a gate driving signal in accordance with a voltage signal on the clock signal line and output the gate driving signal to the gate line. The control circuit is configured to, when the display panel is in the folded state and one second shift register unit of the at least one level of second shift register unit is performing a gate driving scanning operation, apply a first voltage signal to the clock signal line, so as to enable the second shift register unit to control a gate line to output a signal for turning off a transistor corresponding to the gate line.

According to the gate driving module in the embodiments of the present disclosure, instead of dividing the gate driving circuit physically (for the gate driving module in the embodiments of the present disclosure, the first shift register sub-circuitry and the second shift register sub-circuitry are connected to each other in a cascaded manner), when the display panel is in the folded state and the second shift register unit (e.g., the second shift register unit corresponds to the second display sub-region where no image is displayed when the display panel is in the folded state) is performing the gate driving scanning operation, the control circuitry may apply the first voltage signal to the clock signal line, so as to enable the second shift register unit to control a gate line to output the signal for turning off the transistor corresponding to the gate line, thereby to prevent any image from being displayed at the second display sub-region. As a result, it is able to display the image in a split-screen manner through time sequence adjustment when the display panel is in the folded state, and reduce the power consumption for a gate driving operation.

During the implementation, the display panel may be, but not limited to, a flexible display panel which is capable of being folded or curled so as to be in a non-planar state.

In actual use, when a transistor of a subpixel connected to a gate line in an active area (AA) of the display panel is a p-type transistor, the first voltage signal may be a high voltage signal, so as to turn off the transistor. When the transistor of the subpixel connected to the gate line in the active area of the display panel is an n-type transistor, the first voltage signal may be a low voltage signal, so as to turn off the transistor. In other words, in the embodiments of the present disclosure, a type of the transistor of the subpixel connected to the gate line in the active area of the display panel will not be particularly defined.

As shown in FIG. 1, when the display panel 10 is in the unfolded state (i.e., a planar state), the display panel 10 may include a display region 11. In FIG. 1, a dotted line represents the folding axis.

Figure 2:
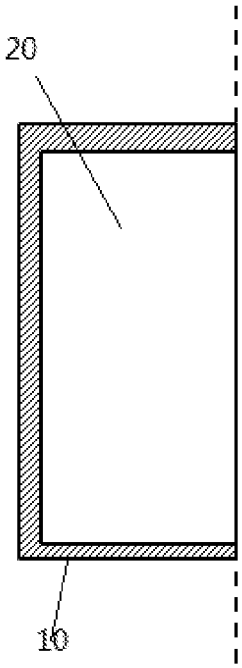
FIG. 2 is a schematic view showing the display panel including the gate driving module in a folded state (i.e., a non-planar state) according to one embodiment of the present disclosure.

As shown in FIG. 2, in a possible embodiment of the present disclosure, when the display panel 10 is in the folded state, the display region is divided by the folding axis into a first display sub-region 20 (when the display panel 10 is in the folded state, the first display sub-region 20 is a front display region where an image is to be displayed normally) and a second display sub-region (when the display panel 10 is in the folded state, i.e., the non-planar state, the second display sub-region is folded in such a manner as to be shielded by the first display sub-region and thus not shown in FIG. 2). In FIG. 2, a dotted line represents the folding axis.

In actual use, there may exist more than one folding axis, i.e., at least two folding axes. When the display panel 10 is in the folded state, the display region 11 may be divided by the at least two folding axes into at least three display sub-regions. For example, when the gate driving module includes two folding axes and the display panel is in the folded state, the display region may include, but not limited to, two first display sub-regions where an image is to be displayed normally, and one second display sub-region where no image is to be displayed.

In a possible embodiment of the present disclosure, there may exist one folding axis, one first shift register sub-circuitry and one second shift register sub-circuitry. A gate driving signal output end of a last-level first shift register unit of the first shift register sub-circuitry may be connected to an input end of a first-level second shift register unit of the second shift register sub-circuitry, and a gate driving signal output end of the first-level second shift register unit of the second shift register sub-circuitry may be connected to a resetting end of the last-level first shift register unit of the first shift register sub-circuitry.

When the display panel is in the folded state and merely divided into two display sub-regions, the last-level first shift register unit of the first shift register sub-circuitry may be connected to the first-level second shift register unit of the second shift-register sub-circuitry, so that the first shift register sub-circuitry and the second shift register sub-circuitry may be connected to each other in a cascaded manner.

In another possible embodiment of the present disclosure, there may exist two folding axes, two first register sub-circuitries, two first display sub-regions corresponding to the first register unit sub-circuitries respectively, one second shift register sub-circuitry and one second display sub-region.

To be specific, a gate driving signal output end of a last-level first shift register unit of a first one of the first shift register sub-circuitries may be connected to an input end of a first-level second shift register unit of the second shift register sub-circuitry.

A gate driving signal output end of the first-level second shift register unit of the second shift register sub-circuitry may be connected to a resetting end of the last-level first shift register unit of the first one of the first shift register sub-circuitries.

A gate driving signal output end of the last-level second shift register unit of the second shift register sub-circuitry may be connected to an input end of a first-level first shift register unit of a second one of the first shift register sub-circuitries.

A gate driving signal output end of the first-level first shift register unit of the second one of the first shift register sub-circuitries may be connected to a resetting end of the last-level second shift register unit of the second shift register sub-circuitry.

In another possible embodiment of the present disclosure, when the display panel is in the folded state, the display panel may be divided into three display sub-regions, i.e., two display sub-regions where an image is to be displayed normally and one display sub-region where no image is to be displayed. In other words, the gate driving module may include two first shift register sub-circuitries and one second shift register sub-circuitry. The first one of the two first shift register sub-circuitries may be connected to the second shift register sub-circuitry in a cascaded manner, and the second shift register sub-circuitry may be connected to the second one of the two first shift register sub-circuitries in a cascaded manner.

To be specific, the first shift register unit may be further connected to the clock signal line, and further configured to generate a gate driving signal in accordance with the voltage signal on the clock signal line and output the gate driving signal to the gate line connected to the first shift register unit.

The control circuit is further configured to, when the display panel is in the folded state and the first shift register unit is performing the gate driving scanning operation, apply the clock signal to the clock signal line, so as to enable the first shift register unit to control a gate line to output a signal for turning on the transistor corresponding to the gate line.

When the display panel is in the folded state (i.e., the non-planar state) and the first shift register unit at the first display sub-region where an image is to be displayed normally is performing the gate driving scanning operation, the control circuit may apply the clock signal to the clock signal line normally, so as to enable the first shift register unit to control the gate line to output the signal for turning on the transistor corresponding to the gate line, thereby to enable the image to be displayed normally at the first display sub-region.

To be specific, the control circuit is further configured to, when the display panel is in the unfolded state (i.e., the planar state), apply the clock signal to the clock signal line, so as to enable the first shift register unit to control the gate line to output the signal for turning on the transistor corresponding to the gate line when the first shift register unit is performing the gate driving scanning operation, and enable the second shift register unit to control the gate line to output the signal for turning on the transistor corresponding to the gate line when the second shift register unit is performing the gate driving scanning operation.

Figure 3:
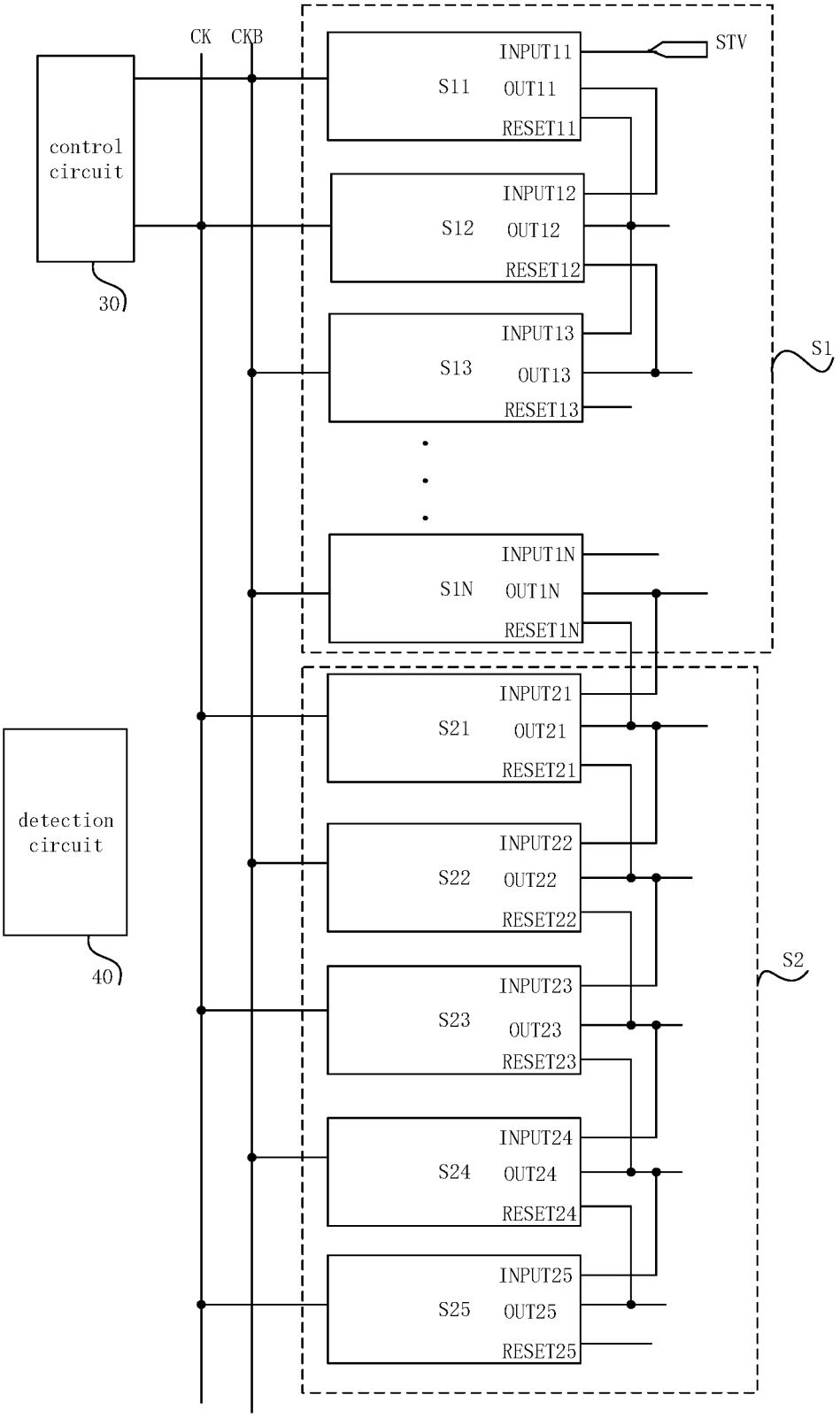
FIG. 3 is a schematic view showing the gate driving module according to one embodiment of the present disclosure.

Correspondingly, when the display panel is in the unfolded state, as shown in FIG. 3, the control circuit 30 may apply the clock signal to the clock signal line normally, so as to display the image normally at the display region of the display panel.

To be specific, the control circuit 30 may be implemented as an IC chip, which includes a memory storing therein a relevant computer program and a processor for calling the computer program and executing relevant processing. The computer program may be executed by the processor, so as to enable the control circuit 30 to apply the clock signal to the clock signal line normally, thereby to display the image normally at the display region of the display panel.

During the implementation, as shown in FIG. 3, the gate driving module may further include a detection circuit 40 configured to detect whether the display panel is in the folded state or the unfolded state, generate a corresponding state indication signal, and transmit the state indication signal to the control circuit 30.

Correspondingly, the gate driving module may further include the detection circuit 40, so as to detect a state of the display panel.

To be specific, the detection circuit 40 may be a device capable of capturing a real-time image or a real-time state of the display panel, e.g., an electronic camera, a video camera, or an image sensor.

During the implementation, the control circuit 30 is further configured to, within a black image display time period immediately before a folding time period, apply a predetermined data voltage to a data line connected to a subpixel at the second display sub-region, thereby to enable the subpixel to display a black image. The folding time period may be a time period within which a first voltage signal is applied by the control circuit to the clock signal line.

A duration of the black image display time period may be set in accordance with the practical need. For example, the black image display time period may be one frame, and the control circuit may, within one frame before a time period within which the first voltage signal is applied to the clock signal line, control the subpixels at the second display sub-region to display a black image, so as to be ready for the folded state.

In a possible embodiment of the present disclosure, the clock signal line may include a first clock signal line and a second clock signal line.

Odd-numbered-level first shift register units of the first shift register sub-circuitry may be connected to the first clock signal input end, and even-numbered-level first shift register units of the first shift register sub-circuitry may be connected to the second clock signal input end.

The first shift register sub-circuitry may include even-numbered levels of first shift register units. Odd-numbered-level second shift register units of the second shift register sub-circuitry may be connected to the first clock signal input end, and even-numbered-level second shift register units of the second shift register sub-circuitry may be connected to the second clock signal input end.

During the implementation, when the clock signal line includes the first clock signal line and the second clock signal line, for the gate driving module in the embodiments of the present disclosure, the odd-numbered-level shift register units of the gate driving circuit may be connected to the first clock signal line, and the even-numbered-level shift register units of the gate driving circuit may be connected to the second clock signal line. When the first shift register sub-circuitry includes even-numbered levels of first shift register units, the odd-numbered-level second shift register units of the second shift register sub-circuitry may be the odd-numbered-level shift register units of the gate driving circuit, and the even-numbered-level second shift register units of the second shift register sub-circuitry may be the even-numbered-level shift register units of the gate driving circuit.

In another possible embodiment of the present disclosure, the clock signal line may include a first clock signal line and a second clock signal line.

Odd-numbered-level first shift register units of the first shift register sub-circuitry may be connected to the first clock signal input end, and even-numbered-level first shift register units of the first shift register sub-circuitry may be connected to the second clock signal input end.

The first shift register sub-circuitry may include odd-numbered levels of first shift register units. Odd-numbered-level second shift register units of the second shift register sub-circuitry may be connected to the second clock signal input end, and even-numbered-level second shift register units of the second shift register sub-circuitry may be connected to the first clock signal input end.

During the implementation, when the clock signal line includes the first clock signal line and the second clock signal line, for the gate driving module in the embodiments of the present disclosure, the odd-numbered-level shift register units of the gate driving circuit may be connected to the first clock signal line, and the even-numbered-level shift register units of the gate driving circuit may be connected to the second clock signal line.

During the implementation, when the clock signal line includes the first clock signal line and the second clock signal line, for the gate driving module in the embodiments of the present disclosure, the odd-numbered-level shift register units of the gate driving circuit may be connected to the first clock signal line, and the even-numbered-level shift register units of the gate driving circuit may be connected to the second clock signal line. When the first shift register sub-circuitry includes odd-numbered levels of first shift register units, the even-numbered-level second shift register units of the second shift register sub-circuitry may be the odd-numbered-level shift register units of the gate driving circuit, and the odd-numbered-level second shift register units of the second shift register sub-circuitry may be the even-numbered-level shift register units of the gate driving circuit.

In actual use, the number of the clock signal lines may not be limited to two, and there may exist 2A clock signal lines, where A is a positive integer. For example, when A is 2, there may exist four clock signal lines. At this time, a $(4a-3)^{th}$-level shift register unit of the gate driving circuit may be connected to a first clock signal line, a $(4a-2)^{th}$-level shift register unit of the gate driving circuit may be connected to a second clock signal line, a $(4a-1)^{th}$-level shift register unit of the gate driving circuit may be connected to a third clock signal line, and a $(4a)^{th}$-level shift register unit of the gate driving circuit may be connected to a fourth clock signal line, where a is a positive integer, and $4a$ is smaller than or equal to the number of levels of the shift register units of the gate driving circuit.

The gate driving module will be described hereinafter in more details in conjunction with a specific embodiment.

In this embodiment of the present disclosure, the gate driving module may be applied to a display panel provided with a display region. When the display panel is in the folded state, the display region may be divided by the folding axis into a first display sub-region and a second display sub-region. The display driving module may include a gate driving circuit.

As shown in FIG. 3, the gate driving circuit may include a first shift register sub-circuitry S1 and a second shift register sub-circuitry S2 connected to each other in a cascaded manner.

The first shift register sub-circuitry S1 may include N levels of shift register units. In FIG. 3, S11 represents a first-level first shift register unit, S12 represents a second-level first shift register unit, S13 represents a third-level first shift register unit, and S1N represents an $N^{th}$-level first shift register unit, where N is an odd number greater than 3.

Similarly, the second shift register sub-circuitry S2 may include a first-level second shift register unit S21, a second-level second shift register unit S22, a third-level second shift register unit S23, a fourth-level second shift register unit S24 and a fifth-level second shift register unit S25.

As shown in FIG. 3, the gate driving module may further include a control circuit 30.

S11 may be connected to a first gate line (not shown in FIG. 3) at the first display sub-region, S12 may be connected to a second gate line (not shown in FIG. 3) at the first display sub-region, S13 may be connected to a third gate line (not shown in FIG. 3) at the first display sub-region, and S1N may be connected to an $N^{th}$ gate line (not shown in FIG. 3) at the first display sub-region.

S21 may be connected to a first gate line (not shown in FIG. 3) at the second display sub-region, S22 may be connected to a second gate line (not shown in FIG. 3) at the second display sub-region, S23 may be connected to a third gate line (not shown in FIG. 3) at the second display sub-region, S24 may be connected to a fourth gate line (not shown in FIG. 3) at the second display sub-region, and S25 may be connected to a fifth gate line (not shown in FIG. 3) at the second display sub-region.

S11 may be connected to a first clock signal line CKB, S12 may be connected to a second clock signal line CK, S13 may be connected to the first clock signal lien CKB, S1N may be connected to the first clock signal line CKB, S21 may be connected to the second clock signal line CK, S22 may be connected to the first clock signal line CKB, S23 may be connected to the second clock signal line CK, S24 may be connected to the first clock signal line CKB, and S25 may be connected to the second clock signal line CK.

A start signal STV may be applied to an input end INPUT11 of S11, a resetting end RESET11 of S11 may be connected to a gate driving signal output end OUT12 of S12, an input end INPUT12 of S12 may be connected to a gate driving signal output end OUT11 of S11, a resetting end RESET12 of S12 may be connected to a gate driving signal output end OUT13 of S13, an input end of S13 may be connected to the gate driving signal output end OUT12 of S12, a resetting end RESET13 of S13 may be connected to a gate driving signal output end of the fourth-level first shift register unit (not shown in FIG. 3), an input end of S1N INPUT1N may be connected to a gate driving signal output end of an $(N-1)^{th}$-level first shift register unit (not shown in FIG. 3), a resetting end RESET1N of S1N may be connected to a gate driving signal output end OUT21 of S21, an input end INPTU21 of S21 may be connected to a gate driving signal output end OUT1N of S1N, a resetting end RESET21 of S21 may be connected to a gate driving signal output end OUT22 of S22, an input end INPTU22 of S22 may be connected to the gate driving signal output end OUT21 of S21, a resetting end RESET22 of S22 may be connected to a gate driving signal output end OUT23 of S23, an input end INPTU23 of S23 may be connected to the gate driving signal output end OUT22 of S22, a resetting end RESET23 of S23 may be connected to a gate driving signal output end OUT24 of S24, an input end INPUT24 of S24 may be connected to a gate driving signal output end OUTPUT 23 of S23, a resetting end RESET24 of S24 may be connected to a gate driving signal output end OUT25 of S25, and an input end INPUT25 of S25 may be connected to the gate driving signal output end OUT24 of S24.

In addition, an external resetting signal (not shown in FIG. 3) may be applied to a resetting end RESET25 of S25.

The control circuit 30 maybe connected to the first clock signal line CKB and the second clock signal line CK.

Figure 4:
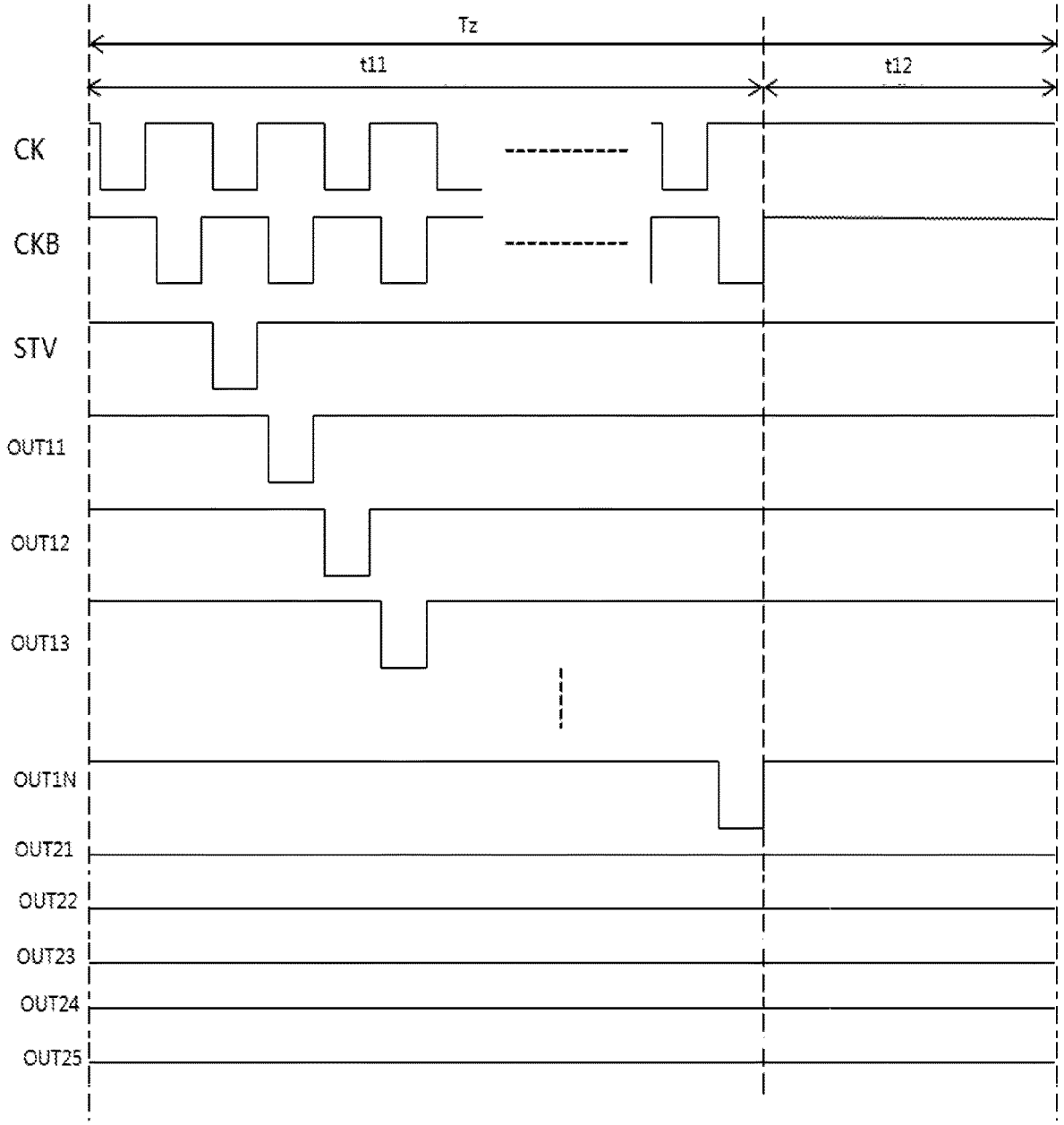
FIG. 4 is a sequence diagram of the gate driving module when the display panel is in the folded state according to one embodiment of the present disclosure.

As shown in FIG. 4, when the display panel is in the folded state, within a display time period t11 of one frame Tz, when S11, S12, S13 and S1N are performing the gate driving scanning operation, the control circuit 30 may apply a first clock signal to CKB and apply a second clock signal to CK, so as to enable S11 to output a signal for turning on a transistor connected to a corresponding gate line through the gate driving signal from OUT11, enable S12 to output a signal for turning on a transistor connected to a corresponding gate line through the gate driving signal from OUT12, enable S13 to output a signal for turning on a transistor connected to a corresponding gate line through the gate driving signal from OUT13, and enable S1N to output a signal for turning on a transistor connected to a corresponding gate line through the gate driving signal from OUT1N, thereby to display an image normally at the first display sub-region when the display panel is folded. Within a non-display time period t12 of each frame, when S21, S22, S23, S24 and S25 are performing the gate driving scanning operation, the control circuit 30 may apply high voltage signals to CKB and CK respectively (at this time, a transistor of each subpixel connected to the corresponding gate line is a p-type transistor), so as to enable S21, S22, S23, S24 and S25 to control gate lines to output signals for turning off the transistors corresponding to the gate lines respectively, thereby to prevent any image from being displayed at the second display sub-region.

During the implementation, the control circuit may be connected to CK and CKB.

Figure 5:
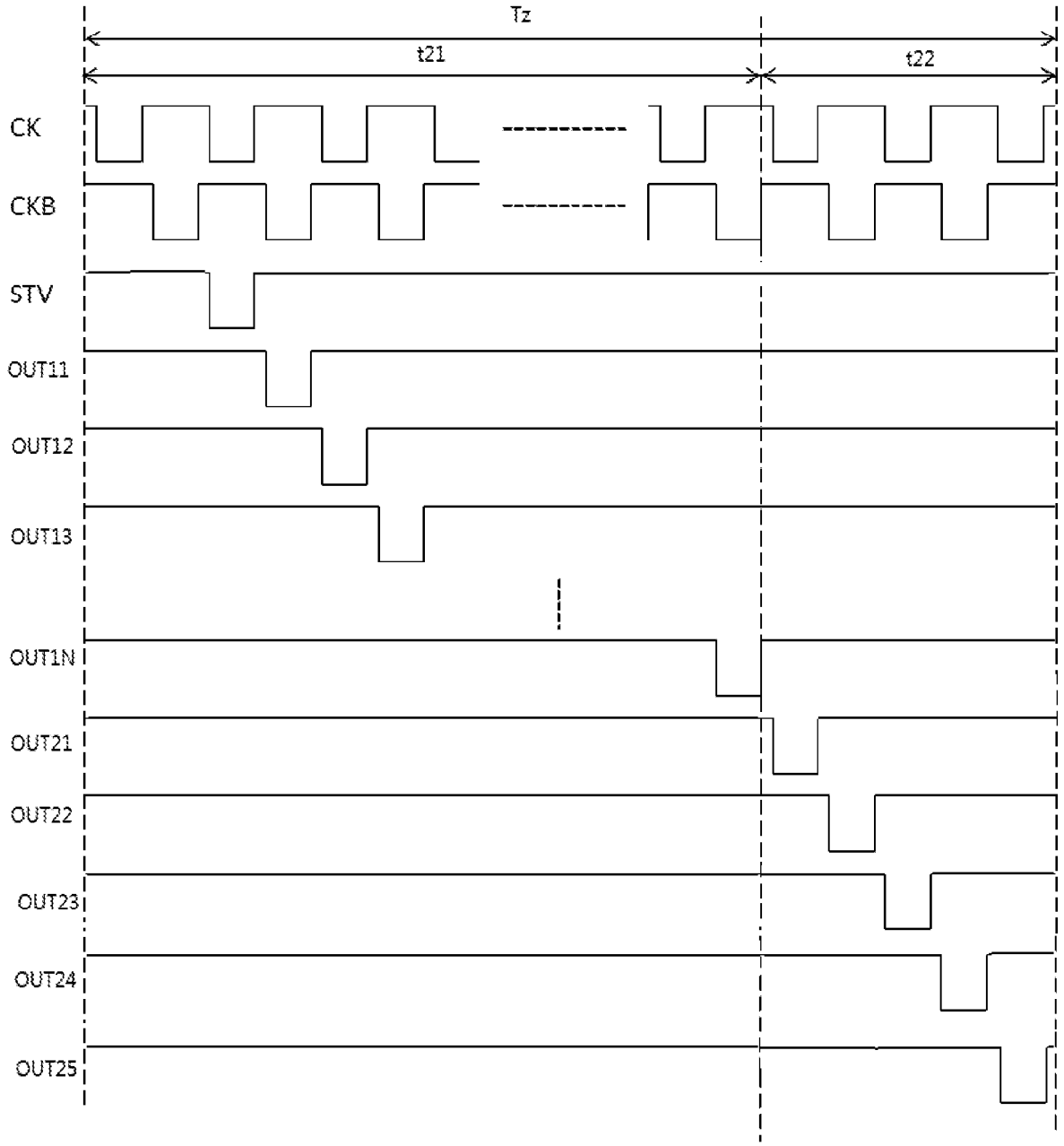
FIG. 5 is another sequence diagram of the gate driving module when the display panel is in the unfolded state according to one embodiment of the present disclosure.

As shown in FIG. 5, when the display panel is in the unfolded state, within a first display time period t21 of one frame display time Tz, when S11, S12, S13 and S1N are performing the gate driving scanning operation, the control circuit 30 may apply the first clock signal to CKB and apply the second clock signal to CK, so as to enable S11 to output a signal for turning on a transistor connected to a corresponding gate line through the gate driving signal from OUT11, enable S12 to output a signal for turning on a transistor connected to a corresponding gate line through the gate driving signal from OUT12, enable S13 to output a signal for turning on a transistor connected to a corresponding gate line through the gate driving signal from OUT13, and enable S1N to output a signal for turning on a transistor connected to a corresponding gate line through the gate driving signal from OUT1N, thereby to display an image normally at the first display sub-region when the display panel is unfolded. Within a second display time period t22 of each frame display time Tz, when S21, S22, S23, S24 and S25 are performing the gate driving scanning operation, the control circuit 30 may apply the first clock signal to CKB and apply the second clock signal to CK, so as to enable S21 to output a signal for turning on a transistor connected to a corresponding gate line through the gate driving signal from OUT21, enable S22 to output a signal for turning on a transistor connected to a corresponding gate line through the gate driving signal from OUT22, enable S23 to output a signal for turning on a transistor connected to a corresponding gate line through the gate driving signal from OUT23, enable S24 to output a signal for turning on a transistor connected to a corresponding gate line through the gate driving signal from OUT24, and enable S25 to output a signal for turning on a transistor connected to a corresponding gate line through the gate driving signal from OUT25, thereby to display an image normally at the second display sub-region when the display panel is unfolded.

During the implementation, within one frame before a time period within which the high voltage signals are applied to CK and CKB, the control circuit 30 may apply a black-state voltage to the second display sub-region, so as to be ready for the folded state where no image is to be displayed at the second display sub-region.

During the operation of the gate driving module, when the display panel is in the folded state and an image is to be displayed in a half-screen manner, it is merely necessary for the control circuit 30 to apply the high voltage signals to CKB and CK within the non-display time period t12 of one frame display time Tz. No pulse signal is outputted by CK and CKB any longer, so it is able to reduce the power consumption for the gate driving operation. In the embodiments of the present disclosure, the half-screen display is achieved through the time sequence adjustment, so it is able flexibly adjust a position where the image is to be displayed in a half-screen manner. For example, it is merely necessary to adjust a time sequence of the signals on CK and a time sequence of the signals on CKB, so as to adjust a position of the folding axis from an $N^{th}$ gate line to an $M^{th}$ gate (M is a positive integer) line at the display region. As a result, it is able to improve the compatibility of the display panel.

The present disclosure further provides in some embodiments a gate driving control method for use in the above-mentioned gate driving module. The gate driving control method includes, when the display panel is in the folded state and the second shift register unit is performing the gate driving scanning operation, applying, by the control circuit, a first voltage signal to the clock signal line, so as to enable the second shift register unit to control the gate line to output a signal for turning off the transistor corresponding to the gate line.

According to the gate driving control method in the embodiments of the present disclosure, instead of dividing the gate driving circuit physically, when the display panel is in the folded state and the second shift register unit is performing the gate driving scanning operation, the control circuitry may apply the first voltage signal to the clock signal line, so as to enable the second shift register unit to control the gate line to output the signal for turning off the transistor corresponding to the gate line, thereby to prevent any image from being displayed at the second display sub-region. As a result, it is able to display the image in a split-screen manner through time sequence adjustment when the display panel is in the folded state, and reduce the power consumption for a gate driving operation.

In actual use, the first shift register unit may be further connected to the clock signal line. The gate driving control method may further include, when the display panel is in the folded state and the first shift register unit is performing the gate driving scanning operation, applying, by the control circuit, a clock signal to the clock signal line, so as to enable the first shift register unit to control the gate line to output a signal for turning on the transistor corresponding to the gate line.

When the display panel is in the folded state and the first shift register unit at the first display sub-region where an image is to be displayed normally is performing the gate driving scanning operation, the control circuit may apply the clock signal to the clock signal line normally, so as to enable the first shift register unit to control the gate line to output the signal for turning on the transistor corresponding to the gate line, thereby to display the image normally at the first display sub-region.

To be specific, gate driving control method may further include, when the display panel is in the unfolded state, applying, by the control circuit, a clock signal to the clock signal line, so as to enable the first shift register unit to control the gate line to output the signal for turning on the transistor corresponding to the gate line when the first register unit is performing the gate driving scanning operation, and enable the second shift register unit to control the gate line to output the signal for turning on the transistor corresponding to the gate line when the second shift register unit is performing the gate driving scanning operation.

When the display panel is in the unfolded state, the control circuit may apply the clock signal to the clock signal line normally, so as to display an image at the display region of the display panel normally.

To be specific, the gate driving module may further include a detection circuit, and the gate driving control method may further include detecting, by the detection circuit, whether the display panel is in the folded state or the un-folded state, generating a corresponding state indication signal, and transmitting the state indication signal to the control circuit.

To be specific, the detection circuit may be any device capable of capturing a real-time image or a real-time state of the display panel, e.g., an electronic camera, a video camera or an image sensor.

During the implementation, the gate driving control method may further include, within a black image display time period immediately before a non-planar time period, applying a predetermined data voltage to a data line connected to a subpixel at a second display sub-region, so as to enable the subpixel to display a black image. The non-planar time period may be a time period within which a first voltage signal is applied by the control circuit to the clock signal line.

A duration of the black image display time period may be set in accordance with the practical need. For example, the black image display time period may be one frame display time, and the control circuit may, within one frame display time before a time period within which the first voltage signal is applied to the clock signal line, control the subpixels at the second display sub-region to display a black image, so as to be ready for the folded state.

The present disclosure further provides in some embodiments a display device including the above-mentioned gate driving module.

To be specific, the display device may further include a driving integrated circuit and a plurality of gate lines extending in a first direction. Each folding axis may extend in the first direction, and a control circuit of the gate driving module may be arranged in the driving integrated circuit.

During the implementation, the control circuit may be arranged in the driving integrated circuit (IC), and the folding axis and the plurality of gate lines may all extend in the first direction.

During the implementation, a gate driving circuit of the gate driving module may be arranged at a peripheral region of a display panel to which an extension direction of the plurality of gate lines points.

In a possible embodiment of the present disclosure, the plurality of gate lines may be arranged in a longitudinal direction, the gate driving circuit of the gate driving module may be arranged at an upper side or a lower side of the display panel, and the longitudinal direction may be substantially the same as the first direction.

When the display panel is of a small size, the gate driving module may merely include one gate driving circuit. When the plurality of gate lines and the folding axis are arranged in the longitudinal direction, the gate driving circuit may be arranged at the upper side or the lower side of the display panel, and the longitudinal direction may be substantially the same as the first direction.

In another possible embodiment of the present disclosure, the plurality of gate lines may be arranged in a longitudinal direction. The gate driving module may include two gate driving circuits that are a first gate driving circuit and a second gate driving circuit. The first gate driving circuit may be arranged at an upper side of the display panel in such a manner that each shift register unit is connected to an upper end of the corresponding gate line, and a second gate driving circuit may be arranged at a lower side of the display panel in such a manner that each shift register unit is connected to a lower end of the corresponding gate line.

When the display panel is of a relatively large size, the gate driving module may include two gate driving circuits, i.e., the first gate driving circuit arranged at the upper side of the display panel, and the second gate driving circuit arranged at the lower side of the display panel. The gate driving scanning operation may be performed on the gate lines simultaneously through the first gate driving circuit and the second gate driving circuit.

Figure 6:
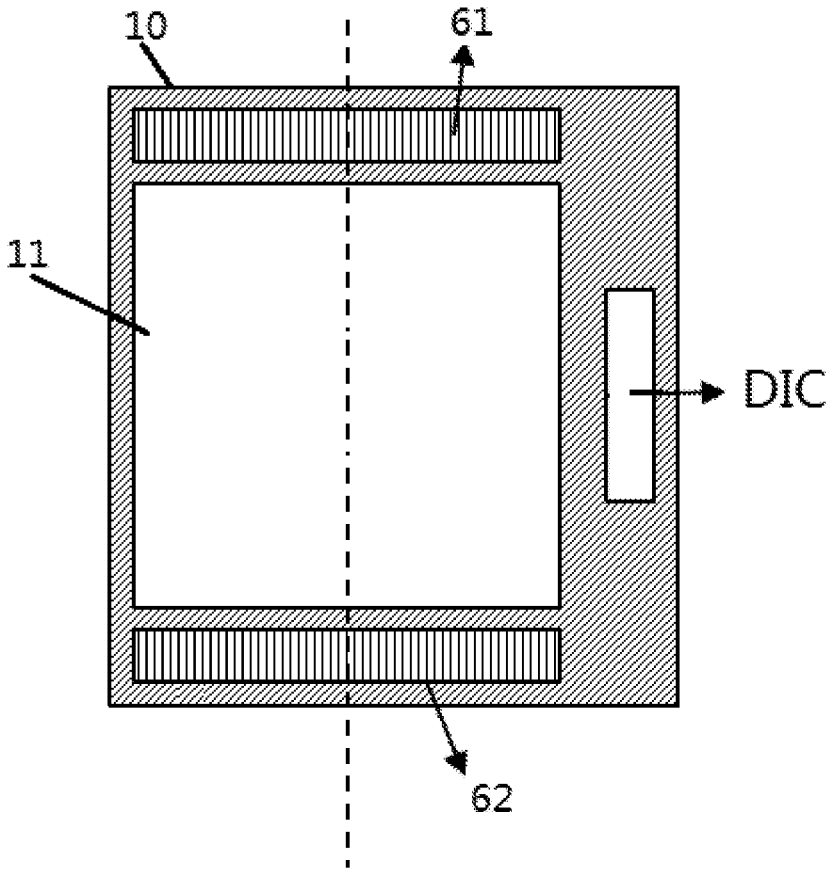
FIG. 6 is a schematic view showing a display device according to one embodiment of the present disclosure.

As shown in FIG. 6, when the display panel 10 is in the unfolded stated, the display panel 10 may include a display region 11. In FIG. 6, a dotted line represents the folding axis. A display sub-region on the left of the folding axis is the first display sub-region, and a display sub-region on the right of the folding axis is the second display sub-region.

In FIG. 6, reference number 61 represents the first gate driving circuit, reference number 62 represents the second gate driving circuit, and DIC represents the driving IC. The control circuit may be arranged in the driving IC.

The first gate driving circuit 61 may include a plurality of shift register units (not shown) connected to each other in a cascaded manner, and the second gate driving circuit 62 may include a plurality of shift register units (not shown) connected to each other in a cascaded manner.

In actual use, the first gate driving circuit and the second gate driving circuit may each be a GOA circuit.

The display device may be any product or member having a display function, e.g., electronic paper, organic light-emitting diode (OLED) display device, liquid crystal display (LCD) device, mobile phone, flat-panel computer, television, display, laptop computer, digital photo frame or navigator.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A gate driving module for use in a display device, wherein the display device is provided with a display region, when the display panel is in a non-planar state, the display region comprises a plurality of display sub-regions, wherein the gate driving module comprises a gate driving circuit;

the gate driving circuit comprises a plurality of shift register sub-circuitries connected to each other in a cascaded manner;

a first shift register sub-circuitry of the plurality of shift register sub-circuitries comprises at least one level of first shift register unit, and a second shift register sub-circuitry of the plurality of shift register sub-circuitries comprises at least one level of second shift register unit;

the gate driving module further comprises a control circuit;

each first shift register unit of the at least one level of first shift register unit is connected to a gate line at a first display sub-region of the plurality of display sub-regions;

each second shift register unit of the at least one level of second shift register unit is connected to a clock signal line and a gate line arranged at a second display sub-region of the plurality of display sub-regions, and configured to generate a gate driving signal in accordance with a voltage signal on the clock signal line and output the gate driving signal to the gate line; and the control circuit is configured to, when the display panel is in the non-planar state and one second shift register unit of the at least one level of second shift register unit is performing a gate driving scanning operation, apply a first voltage signal to the clock signal line, so as to enable the second shift register unit to control the gate line to output a signal for turning off a transistor corresponding to the gate line.

2. The gate driving module according to claim 1, wherein when the display panel is in the non-planar state, the display panel is folded, and the display region is divided by one or more folding axes into a plurality of display sub-regions; or when the display panel is the non-planar state, the display panel is curled.

3. The gate driving module according to claim 2, wherein there are one folding axis, one first shift register sub-circuitry and one second shift register sub-circuitry;

a gate driving signal output end of a last-level first shift register unit of the first shift register sub-circuitry is connected to an input end of a first-level second shift register unit of the second shift register sub-circuitry; and a gate driving signal output end of the first-level second shift register unit of the second shift register sub-circuitry is connected to a resetting end of the last-level first shift register unit of the first shift register sub-circuitry.

4. The gate driving module according to claim 2, wherein there are two folding axes, two first register sub-circuitries, two first display sub-regions corresponding to the first register unit sub-circuitries respectively, one second shift register sub circuitry and one second display sub-region;

a gate driving signal output end of a last-level first shift register unit of a first one of the first shift register sub-circuitries is connected to an input end of a first-level second shift register unit of the second shift register sub-circuitry;

a gate driving signal output end of the first-level second shift register unit of the second shift register sub-circuitry is connected to a resetting end of the last-level first shift register unit of the first one of the first shift register sub-circuitries;

a gate driving signal output end of the last-level second shift register unit of the second shift register sub-circuitry is connected to an input end of a first-level first shift register unit of a second one of the first shift register sub-circuitries; and a gate driving signal output end of the first-level first shift register unit of the second one of the first shift register sub-circuitries is connected to a resetting end of the last-level second shift register unit of the second shift register sub-circuitry.

5. The gate driving module according to claim 1, wherein the first shift register unit is further connected to the clock signal line, and configured to generate a gate driving signal in accordance with the voltage signal on the clock signal line and output the gate driving signal to the gate line connected to the first shill register unit; and the control circuit is further configured to, when the display panel is in the non-planar state and the first shill register unit is performing a gate driving scanning operation, apply the clock signal to the clock signal line, so as to enable the first shift register unit to control the gate line to output a signal for turning on the transistor corresponding to the gate line.

6. The gate driving module according to claim 1, wherein the control circuit is further configured to, when the display panel is in the planar state, apply the clock signal to the clock signal line, so as to enable the first shift register unit to control the gate line to output a signal for turning on the transistor corresponding to the gate line when the first shift register unit is performing a gate driving scanning operation, and enable the second shift register unit to control the gate line to output a signal for turning on the transistor corresponding to the gate line when the second shift register unit is performing a gate driving scanning operation.

7. The gate driving module according to claim 6, wherein when the display panel is in a planar state, the display panel is changed from a folded state to an unfolded state; or when the display panel is in the planar state, the display panel is changed from a curled state to the unfolded state.

8. The gate driving module according to claim 1, further comprising a detection circuit configured to detect whether the display panel is in the non-planar state or the planar state, generate a corresponding state indication signal, and transmit the state indication signal to the control circuit.

9. The gate driving module according to claim 1, wherein the control circuit is further configured to, within a black image display time period immediately before a non-planar time period, apply a predetermined data voltage to a data line connected to a subpixel at the second display sub-region, thereby to enable the subpixel to display a black image; and the non-planar time period is a time period within which a first voltage signal is applied by the control circuit to the clock signal line.

10. The gate driving module according to claim 1, wherein the clock signal line comprises a first clock signal line and a second clock signal line;

odd-numbered-level first shift register units of the first shift register sub-circuitry are connected to the first clock signal input end, and even-numbered-level first shift register units of the first shift register sub-circuitry are connected to the second clock signal input end; and the first shift register sub-circuitry comprises even-numbered levels of first shift register units, odd-numbered-level second shift register units of the second shift register sub-circuitry are connected to the first clock signal input end, and even-numbered-level second shift register units of the second shift register sub-circuitry are connected to the second clock signal input end.

11. The gate driving module according to claim 1, wherein the clock signal line comprises a first clock signal line and a second clock signal line;

odd-numbered-level first shift register units of the first shill register sub-circuitry are connected to the first clock signal input end, and even-numbered-level first shift register units of the first shift register sub-circuitry are connected to the second clock signal input end; and the first shift register sub-circuitry comprises odd-numbered levels of first shift register units, odd-numbered-level second shift register units of the second shift register sub-circuitry are connected to the second clock signal input end, and even-numbered-level second shift register units of the second shift register sub-circuitry are connected to the first clock signal input end.

12. A gate driving control method for use in the gate driving module according to claim 1, comprising, when the display panel is in a non-planar state and the second shift register unit is performing a gate driving scanning operation, applying, by the control circuit, a first voltage signal to the clock signal line, so as to enable the second shill register unit to control the gate line to output a signal for turning off the transistor corresponding to the gate line.

13. The gate driving control method according to claim 12, wherein the first shift register unit is further connected to the clock signal line, wherein the gate driving control method further comprises, when the display panel is in the non-planar state and the first shift register unit is performing the gate driving scanning operation, applying, by the control circuit, a clock signal to the clock signal line, so as to enable the first shift register unit to control the gate line to output a signal for turning on the transistor corresponding to the gate line.

14. The gate driving control method according to claim 12, further comprising, when the display panel is in a planar state, applying, by the control circuit, a clock signal to the clock signal line, so as to enable the first shift register unit to control the gate line to output the signal for turning on the transistor corresponding to the gate line when the first register unit is performing the gate driving scanning operation, and enable the second shift register unit to control the gate line to output the signal for turning on the transistor corresponding to the gate line when the second shift register unit is performing the gate driving scanning operation.

15. A display device, comprising the gate driving module according to claim 1.

16. The display device according to claim 15, further comprising a driving integrated circuit and a plurality of gate lines extending in a first direction, wherein each folding axis extends in the first direction, and a control circuit of the gate driving module is arranged in the driving integrated circuit.

17. The display device according to claim 16, wherein a gate driving circuit of the gate driving module is arranged at a peripheral region of a display panel to which an extension direction of the plurality of gate lines points.

18. The display device according to claim 17, wherein the plurality of gate lines is arranged in a longitudinal direction, the gate driving circuit of the gate driving module is arranged at an upper side or a lower side of the display panel, and the longitudinal direction is substantially the same as the first direction.

19. The display device according to claim 17, wherein the plurality of gate lines is arranged in a longitudinal direction;

the gate driving module comprises two gate driving circuits;

a first gate driving circuit of the two gate driving circuits is arranged at an upper side of the display panel in such a manner that each shill register unit is connected to an upper end of the corresponding gate line, and a second gate driving circuit of the two gate driving circuits is arranged at a lower side of the display panel in such a manner that each shift register unit is connected to a lower end of the corresponding gate line; and the longitudinal direction is substantially the same as the first direction.

20. The display device according to claim 19, wherein the first gate diving circuit and the second gate driving circuit are each a Gate On Array (GOA) circuit arranged on an array substrate.

* * * * *